US006164910A

United States Patent [19]

Mayleben

[11] Patent Number: 6,164,910

[45] Date of Patent: Dec. 26, 2000

[54] HOUSING ASSEMBLY FOR A FLUID-WORKING DEVICE SUCH AS A ROTARY PUMP

[75] Inventor: Philip Anthony Mayleben, Kenton, Ky.

[73] Assignee: ITT Manufacturing Enterprises, Inc., Wilmington, Del.

[21] Appl. No.: 09/159,078

[22] Filed: Sep. 22, 1998

[51] Int. Cl.[7] ..... F01D 25/24

[52] U.S. Cl. ..... 415/214.1

[58] Field of Search ..... 415/196, 213.1, 415/214.1; 285/112

[56] References Cited

U.S. PATENT DOCUMENTS

| | | | |
|---|---|---|---|
| 1,118,739 | 11/1914 | Carter | 415/213.1 X |
| 2,287,397 | 6/1942 | Rupp | 415/214.1 X |
| 3,249,057 | 5/1966 | Callahan | 415/112 X |
| 3,635,606 | 1/1972 | Blum | 415/213.1 X |
| 3,791,760 | 2/1974 | Lipe | 415/213.1 |
| 4,186,947 | 2/1980 | Nixon | 285/112 |
| 4,274,803 | 6/1981 | Spengler et al. | 415/70 |
| 4,877,371 | 10/1989 | Putt | 415/214.1 X |

*Primary Examiner*—John E. Ryznic
*Attorney, Agent, or Firm*—Menotti J. Lombardi

[57] ABSTRACT

Outer ends of inlet and outlet ducts have annular grooves, in lieu of bolt-holed flanges, to receive the inwardly-extending rims of a two-piece, clamping coupler. The coupler joins a conduit, which has a bight, to the inlet duct, in order to change an end-suction configuration of the device to an in-line configuration, selectively.

8 Claims, 2 Drawing Sheets

HOUSING ASSEMBLY FOR A FLUID-WORKING DEVICE SUCH AS A ROTARY PUMP

BACKGROUND OF THE INVENTION

This invention pertains to fluid-working devices, such as rotary pumps, turbines gas compressors, gas expanders, and the like, and in particular to a housing assembly for such devices, which assembly offers a novel flexibility in usage.

For illustrative purposes, the invention is illustrated and described in connection with a centrifugal pump. Now, with that understanding, it is noted that, commonly, centrifugal pumps need to be configured in two, differing embodiments, namely: end-suction, and in-line. In the end-suction design, the fluid is ingested via an opening which aligns with the rotary axis of the pump, and the fluid is discharged via an opening which subsists in an axis transverse to the rotary axis. For the in-line design of a centrifugal pump, both inlet and discharge openings occupy a same axis, transverse to the rotary axis. Of course, then, to meet the differing demands of customers, pump manufacturers must fabricate and stock both types of pumps. This is expensive, certainly, and calls for some novel arrangement by means of which one basic pump design can be so innovative as to be able to meet either the end-suction or the in-line service requirement.

SUMMARY OF THE INVENTION

It is an object of this invention to set forth a housing assembly, for fluid-working devices, such as a rotary pump, which accomodates end-suction or in-line use, selectively. Particularly, it is an object of this invention to disclose a housing assembly, for a fluid-working device such as a rotary pump, comprising a housing body; said body having first means defining a fluid inlet, and second means defining a fluid outlet; said body further having a given rotary axis, and a second axis transverse to said given axis; and means coupled to said body for selectively changing one of said first and second means from a given alignment with one of said axes to an alignment with the other of said axes.

Further objects of this invention, as well as the novel features thereof, will become apparent by reference to the following description, taken in conjunction with the accompanying figures.

DETAILED DESCRIPTION OF THE INVENTION

Figure 1:
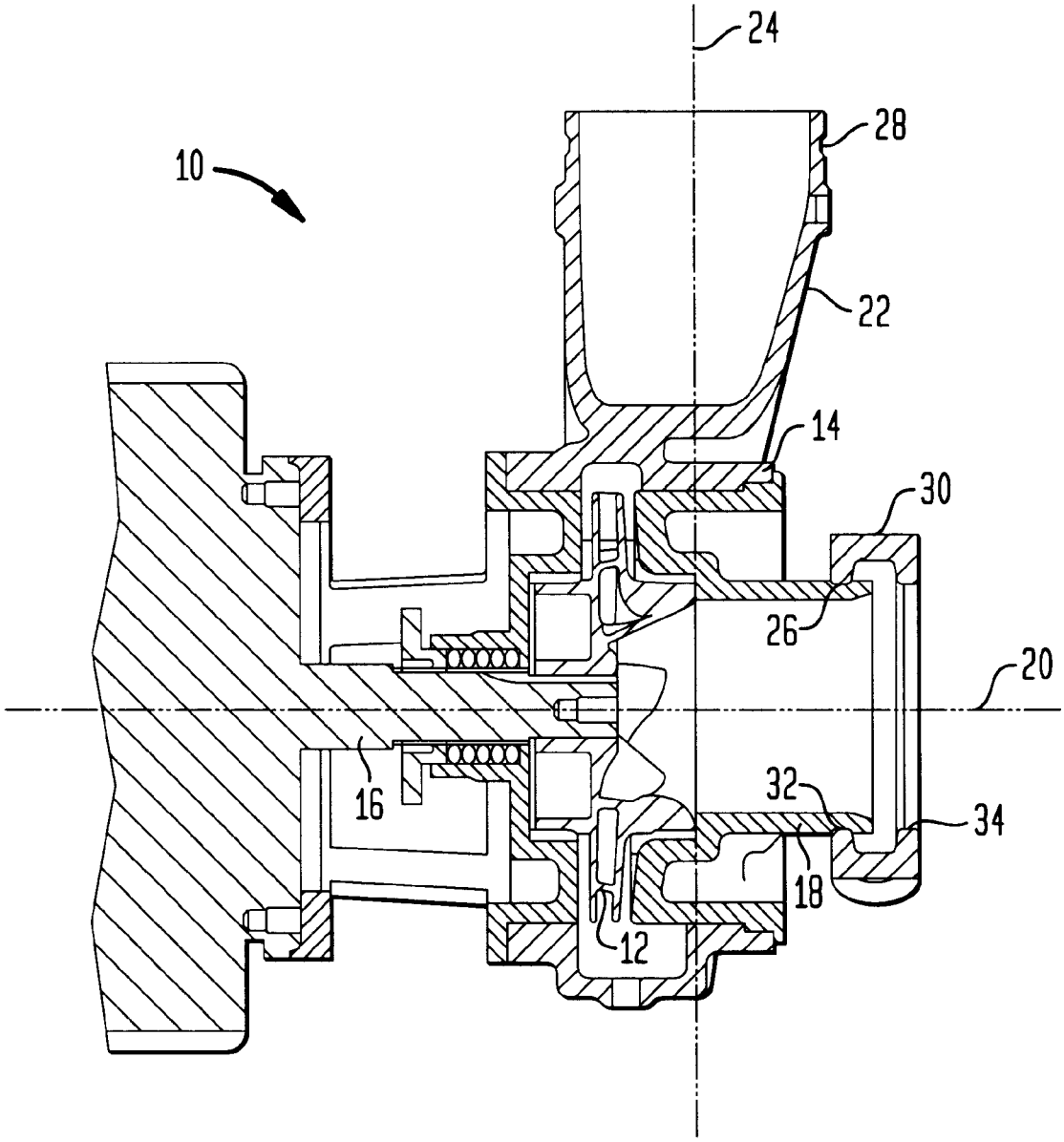
FIG. 1 is an axial cross-section of a centrifugal pump configured according to an embodiment of the invention.

As shown in FIG. 1, a centrifugal pump 10 comprises an impeller 12 journalled in a housing 14, and rotatively driven by a shaft 16 powered by a prime mover (not shown). The pump 10 has an end-suction configuration, in that a fluid-ingesting duct 18 is aligned with the rotary axis 20 of the pump 10. The housing 14 has a fluid-discharging duct 22 which is aligned with an axis 24 which is transverse to the rotary axis 20.

It is typical, in the prior art, for the inlet and discharge ducts of a pump, compressor, turbine or expander, to have bolt-holed flanges formed thereon to facilitate coupling thereof to ancillary devices. According to my invention, the ducts 18 and 22 have no flanges. On the contrary, the ducts 18 and 22 have annular grooves 26 and 28 formed therein, in adjacency to terminations of the ducts. The grooves are provided to receive annular couplings for mating the duct terminations with associated components.

FIG. 1 depicts one of the aforesaid couplings 30, the same comprising a two-part component having a pair of inwardly-extending rims 32 and 34. A coupling of this type, marketed under the trademark VICTAULIC, by the Victaulic Manufacturing Company, is most suitable for the instant purpose. As can be seen, rim 32 nestably engages the groove 26, whereas rim 34 is disposed for engagement with an associative component. Such an associative component is depicted in FIG. 2

Figure 2:
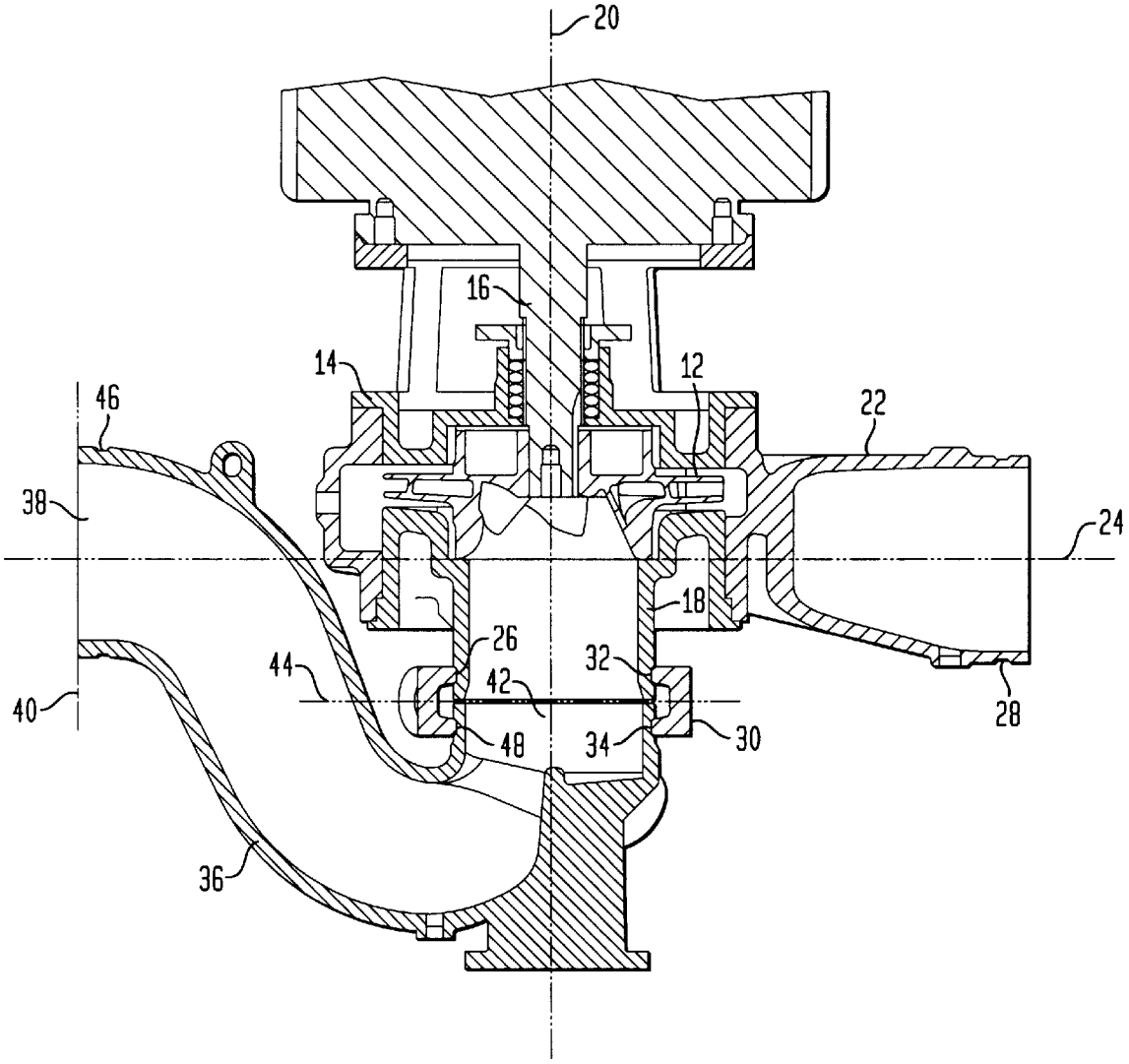
FIG. 2 is another axial cross-section of the pump of FIG. 1 which, however, is simply rotated ninety degrees of arc, and according to the invention, has the fluid inlet selectively changed.

FIG. 2 illustrates the same pump 10, of FIG. 1, now however, rotated clockwise ninety degrees, to show how the fluid inlet can be selectively changed to an alignment with the fluid discharge from an alignment with an axis transverse to the axis of the discharge.

With an end-suction pump configuration in stock, and a need for an in-line pump configuration, the invention teaches a means for converting the former configuration, selectively, to the latter configuration.

As depicted in FIG. 2, a conduit 36 is coupled to the duct 18 by means of the coupling 30. The conduit 36 has a bight formed therein which, as a consequence thereof, disposes one open end 38 thereof in a given plane 40, and causes the other, opposite, open end 42 thereof to subsist in a plane 44 which is perpendicular to plane 40. More grooves 46 and 48 are formed in adjacency to the ends 38 and 42 of the conduit, and the rim 34 of the coupling 30 nestably engages the groove 48. By this means, of course, the conduit 36 is secured to the inlet duct 18 of the housing 14, and disposes the open end 38 in line with the axis 24 of the discharge duct 22. Where the pump 10 had been an end-suction configuration, it becomes an in-line configuration by the expedient of marrying the conduit 36 to the duct 18.

The nature of the coupling 30, especially VICTAULIC couplings of this type, is such that it (a) incorporates an annular gasket or seal (not shown), and (b) accommodates rotary motion of the coupled conduit 36 in its mating with the duct 18. Therefore, it enables a coupling of the end 38 of the conduit 36 in virtually unlimited rotary dispositions about the axis 20 to meet a customer's complementary piping, while inhibiting fluid leakage at the conduit 36-to-duct 18 juncture.

While I have described my invention in connection with a specific embodiment thereof, it is to be clearly understood that this is done only by way of example, and not as a limitation to the scope of my invention as set forth in the objects thereof, and in the appended claims. For instance, the coupling 30 need not be a VICTAULIC coupling. Simply it has to be of two, separable pieces, with the inwardly extending rims 32 and 34, with the pieces articulatable (i.e., openable) to permit the rims to be seated and clamped in the grooves 26 and 28, and with means (not shown) for holding the pieces fast together in closure. In addition, any such coupling needs to have such an aforesaid annular gasket or seal, therewithin, preferably of a durable, elastomeric nature.

I claim:

1. A housing assembly, for a fluid-working device such as a rotary pump, comprising:

a housing body;

said body including a first fluid-conducting elongated duct defining a fluid inlet, and a second fluid-conducting elongated duct defining a fluid outlet, each of said ducts having an outermost termination and an annular groove formed therein adjacent to said termination for receiving an annulus which mates said duct with associated components;

said body further having a given, rotary axis, and a second axis transverse to said given axis;

a conduit for selectively changing one of said first and second ducts from a given alignment with one of said axes to an alignment with the other of said axes; and an annulus for coupling said conduit to said one of said first and second ducts.

2. A housing assembly, according to claim 1, wherein:

said grooves are formed in outer surfaces of said ducts.

3. A housing assembly, according to claim 1, wherein:

the annulus engages one of said grooves in said one of said ducts when coupling said conduit thereto.

4. A housing assembly, according to claim 3, wherein:

said conduit has a bight formed therein.

5. A housing assembly, according to claim 3, wherein:

said conduit has first and second, opposite, open ends; and one of said first and second ends subsists in a given plane, and the other of said ends subsists in a plane which is perpendicular to said given plane.

6. A housing assembly, according to claim 5, wherein:

said ends of said conduit each have an annular groove formed in an outer surface thereof.

7. A housing assembly, according to claim 3, wherein:

said annulus comprises a two-part component having a pair of inwardly-extending rims.

8. A housing assembly, according to claim 6, wherein:

said annulus has a pair of inwardly-extending rims; and one of said rims engagingly nests in one of said grooves in one of said ducts, and the other of said rims engagingly nests in one of said annular grooves in one of said ends.

* * * * *